US005333800A

United States Patent [19]

Takahata et al.

[11] Patent Number: 5,333,800

[45] Date of Patent: Aug. 2, 1994

[54] APPARATUS FOR WINDING WIRE INTO A COIL ON THE INNER SURFACE OF A CYLINDRICAL BODY

[75] Inventors: Toshihiro Takahata; Hiroshi Kawazoe; Toshiichi Murakoshi; Masataka Tokunaga, all of Osaka, Japan

[73] Assignee: Matsushita Electric Industrial Co., Ltd., Osaka, Japan

[21] Appl. No.: 20,821

[22] Filed: Feb. 22, 1993

Related U.S. Application Data

[63] Continuation-in-part of Ser. No. 738,904, Aug. 1, 1991, abandoned.

[30] Foreign Application Priority Data

Aug. 4, 1990 [JP] Japan ..... 2-207477

[51] Int. Cl.[5] ..... H01F 41/06

[52] U.S. Cl. ..... 242/7.01; 29/605; 140/92.2

[58] Field of Search ..... 242/7.01, 7.02, 7.06, 242/7.07, 7.09, 7.17; 140/92.2; 29/605, 606, 602.1, 593

[56] References Cited

U.S. PATENT DOCUMENTS 4,724,604 2/1988 Kawazoe et al. ..... 29/606

4,947,543 8/1990 Kawazoe et al. ..... 29/605

*Primary Examiner*—Stanley N. Gilreath

*Attorney, Agent, or Firm*—Wenderoth, Lind & Ponack

[57] ABSTRACT

A winding apparatus winds wire into a coil in an annular groove of a cylindrical body. The apparatus includes a positioning section at which the cylindrical body is set at a predetermined relative rotary position, a winding section that includes a coil wire supply nozzle to be circulated along the annular groove and a roller for pressing the wire against the surface of the cylindrical body defining the bottom of the annular groove at a position behind the supply nozzle, a tension device capable of selectively applying various states of tension to the wire in accordance with the particular process being carried out at the winding section, and an inspection device for judging whether the coil produced is in an acceptable state.

5 Claims, 19 Drawing Sheets

APPARATUS FOR WINDING WIRE INTO A COIL ON THE INNER SURFACE OF A CYLINDRICAL BODY

This is a Continuation-In-Part of U.S. Ser. No. 07/738,904, filed Aug. 1, 1991 and now abandoned.

BACKGROUND OF THE INVENTION

The present invention relates to an apparatus for winding wire into a coil in an annular groove formed in the internal surface of a cylindrical body such as a rotor of a rotary transformer.

In a conventional method for forming a coil in an annular groove defined in the internal surface of a cylindrical body, wire is preliminarily wound outside of the cylindrical body into a series of annular portions, the annular portions of the wound wire are fixed together by a self-melt bonding technique and are formed into a coil, and thereafter the coil is inserted into the cylindrical body while being deformed until the coil is received in the annular groove of the body- This method has drawbacks in that it is inefficient because of the many processing steps required and in that the quality of the final products is not uniform.

To overcome these drawbacks, Japanese Laid-open Patent Publication No. 61-100911 proposes a method in which wire having a bonding agent preliminarily applied thereto is supplied from a supply nozzle into an annular groove of a cylindrical body, is wound within the groove, and the wire is pressed against the surface of the cylindrical body defining the bottom of the groove by a roller provided behind the supply nozzle in its direction of movement. The wire is thus bonded to the cylindrical body within the annular groove thereof.

However, this method also has drawbacks in that the bonding agent adheres to the roller whereby the coil is thus likely to be wound up on the roller, and in that an end portion of the coil is required to be treated after the bonding agent hardens. Therefore, in another proposed method, the end portion of the coil is lapped (end portion processing) against a connection pin of the cylindrical body and the wire is then wound into a coil in the annular groove of the cylindrical body whereby the bonding agent does not have to be used.

However, since the apparatus for executing the above-described method employs a tension device which imparts a constant tension to the wire as it is being wound into a coil, the winding operation is performed deficiently because the supply nozzle is not able to precisely follow an intricate path during the end portion processing and winding process which are performed in series. Moreover, the wire may become slack resulting in a poorly formed coil.

Meanwhile, it is necessary to position the cylindrical body when conducting the end portion processing. For this purpose, the winding apparatus has been designed to rotate a cylindrical body while pressing the same against a holding base provided with a positioning projection. Rotation of the cylindrical body is stopped when an axial groove defined in internal surface of the cylindrical body receives the positioning projection of the holding base, whereby the cylindrical body is determined to be in a proper relative rotational position. However, there are also drawbacks with this aspect of the prior art in that the cylindrical body may be damaged or chipped and in that the positioning projection is worn so severely that the positioning of the cylindrical body becomes inaccurate.

SUMMARY OF THE INVENTION

Accordingly, an essential object of the present invention is to provide an apparatus for winding wire into a coil in an internal surface of a cylindrical body which is free of substantially all of the above-described drawbacks of the prior art, that is, which is capable of properly winding the wire into a coil without producing slackness in the wire even when end portion processing and a winding process are performed sequentially, and which automatically and sequentially positions the cylindrical body, winds the wire into a coil in the annular groove of the inner peripheral surface of the cylindrical body, and inspects the state of the coil.

To accomplish these and other objects, the present invention provides an apparatus for winding a wire into a coil at an internal surface of a cylindrical body defining an annular groove and an axial groove intersecting the annular groove, and which apparatus comprises: a positioning means for rotating the cylindrical body to a predetermined relative rotary position; a winding means including a coil wire supply nozzle for circulating the wire along the annular groove, and a roller for pressing the wire against a surface of cylindrical body defining the bottom of the annular groove at a position behind the supply nozzle with respect to the direction of movement of the supply nozzle; a tension means capable of selectively applying various tensions to the wire in accordance with the particular process being carried out by the winding means; and an inspection means for judging whether the produced coil is in an acceptable state.

The positioning means may include a device for rotating the cylindrical body around its axis and a device for detecting the axial groove without contacting the cylindrical body.

The tension means may include a mechanism for offering resistance against the drawing out and supplying of the wire to the nozzle, a coil wire press-holding device located along a coil wire supply path to hold the coil wire under pressure, and a coil wire urging device for moving into engagement with the wire to move the wire sideways at a position downstream of the press-holding device thereby increasing the length of the coil wire supply path and tensioning the wire.

The tension means may further include a rod which is self-biased from its free state or has been swung from its free state so as to be biased and has a guide portion at its free end receiving the wire, and a holding device for holding the rod at a predetermined portion thereof.

The inspection means may include a device for detecting whether the wire projects from the annular groove without contacting the wire or the cylindrical body.

Thus, according to the present invention, the positioning of the cylindrical body, the winding of the wire into a coil, and the inspection of the coil are performed automatically and sequentially. Moreover, appropriate tensions can be imparted to the wire, respectively, during the winding process and end portion processing. Thus, slackness is not produced in the wire even though the end portion processing and the winding process are performed sequentially.

Furthermore, the cylindrical body can be positioned without being damaged by the use of the non-contact detecting device forming part of the positioning means.

Still further, by appropriately employing the urging device for engaging the wire in conjunction with the mechanism which offers resistance to the drawing out of the wire, the wire can be prevented from becoming slack during the transition from the end portion processing to the winding process. Thus, the wire will be wound into the coil under proper conditions. Similarly, by using the rod capable of absorbing large fluctuations in the coil wire supply, and by selectively actuating the holding device which can suspend the effect produced by the rod on the wire, large fluctuations in the supply of the wire during end portion processing can be absorbed and a stable tension can be imparted to the wire during end processing. Thus, the wire forming the coil will be in a properly wound state.

Finally, because the inspection means inspects the state of the coil without contacting it or the cylindrical body, the inspection can be automatic and efficient.

BRIEF DESCRIPTION OF THE DRAWINGS

These and other objects and features of the present invention will become clear from the following description made with reference to the accompanying drawings in which.

DETAILED DESCRIPTION OF THE PREFERRED EMBODIMENTS

Figure 1:
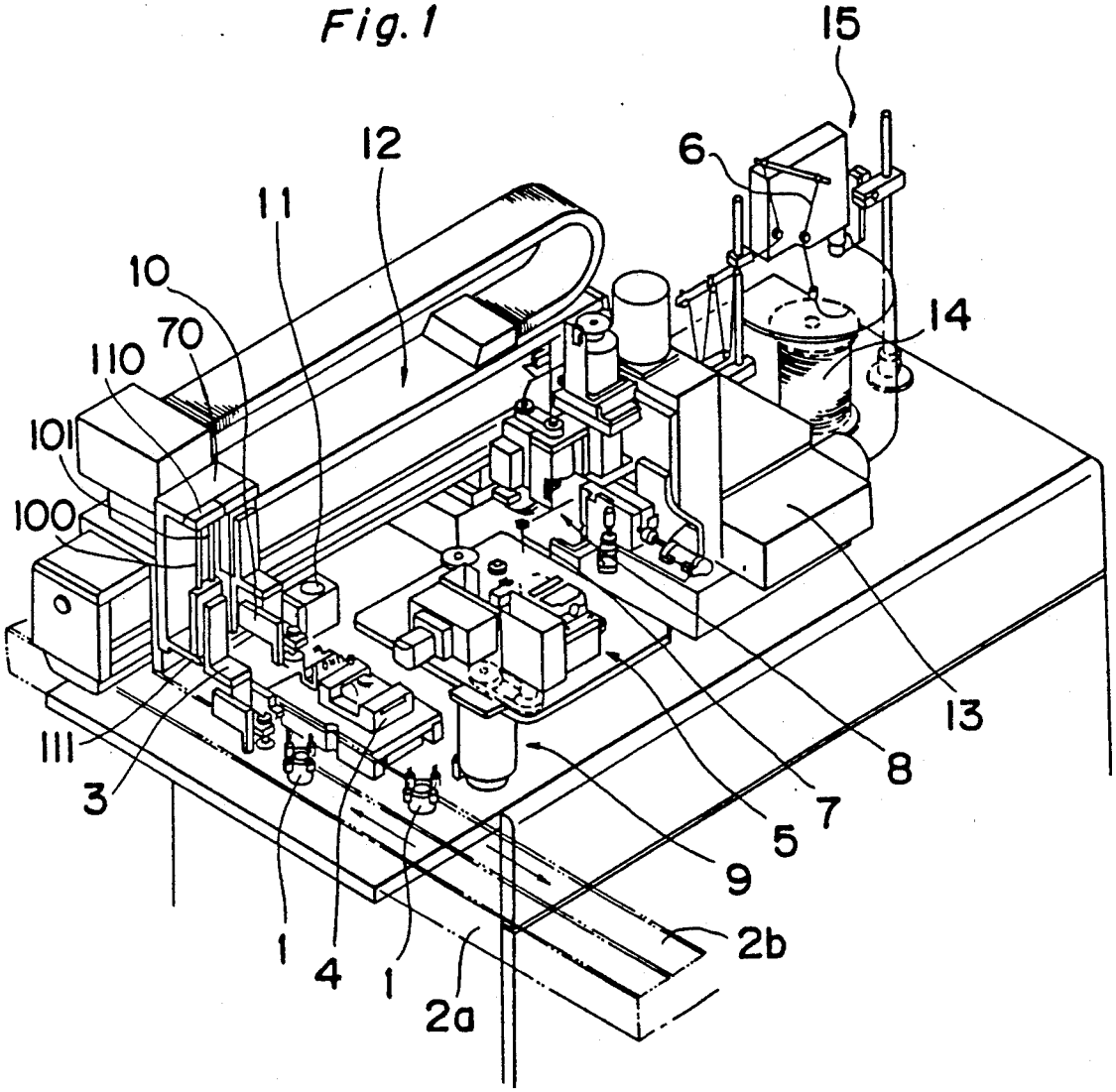
FIG. 1 is a perspective view of an embodiment of an apparatus for winding wire into a coil on the internal surface of a cylindrical body according to the present invention.

Before the description of the present invention proceeds, it is to be noted that like parts are designated by like reference numerals through the accompanying drawings.

Referring to FIG. 1, the overall structure and sequence of operations of the apparatus for winding a wire into a coil on an inner surface of a cylindrical body according to the present invention will be described. A rotor core 1 of a rotary transformer (cylindrical body), which is to have wire wound on the internal surface thereof, is supplied by a carry-in conveyor 2*a*. The carried-in core 1 is transferred to a positioning section 4 by a supply chuck 3. The core 1 is rotated to a predetermined rotary position in the positioning section 4. After being positioned, the core 1 is supplied to the winding section 5 by the supply chuck 3. In the winding section 5, wire is wound along the internal surface of the core 1 by winding head 8 having a supply nozzle 7 and a roller member 9 to thus form a coil. After the winding process, the core 1 is checked by an inspection section 11 to determine whether the core and the coil formed therein constitute an acceptable product. Therefore, the core 1 is transferred onto the carry-out conveyor 2*b* by a discharge chuck 10. Reference numeral 12 designates a transfer robot for driving the supply chuck 3 and the discharge chuck 10. Reference numeral 13 designates an XYZ table for moving the winding head 8 along its intricate path to form the coil. Reference numeral 14 is a bobbin for supplying wire 6 which is to form the coil. Reference numeral 15 designates a tension device for tensioning the coil wire 6.

Next, a more detailed description of the structure and sequence of the operations of the apparatus will be made.

Figure 13:
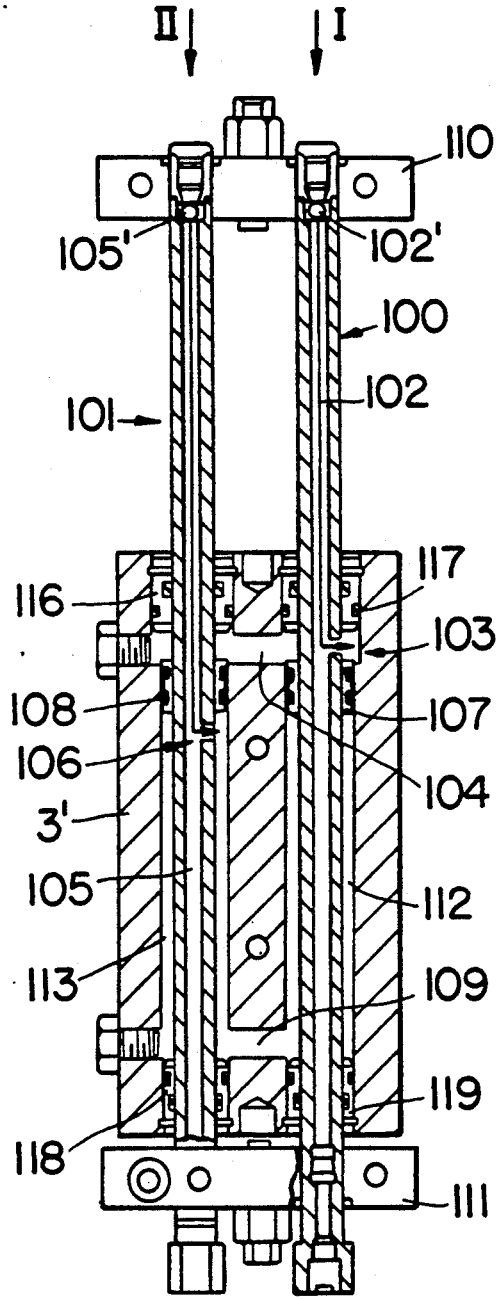
FIG. 13 is a front view, partially in section, of a mechanism for moving the supply chuck vertically in the apparatus.

The robot 12 includes a movable support plate 70 on which the supply chuck 3 and discharge chuck 10 are mounted, and a conventional linear actuator for reciprocating the support plate 70 along a guide in a horizontal direction to locate the chucks 3, 10 at various positions (to be described in more detail later) adjacent the conveyors 2*a*, 2*b*, the positioning section 4 and the winding section 5. The supply chuck 3 and discharge chuck 10 are each supported for vertical movement along respective pairs of vertical guide rods 100, 101. These pairs of guide rods 100, 101 are in turn mounted to the support plate 70 via an upper bar 110 and a lower bar 111. The mechanism for moving the supply chuck 3 vertically along the rods 100, 101 will now be described with reference to FIG. 13. Since the mechanism for moving the discharge chuck 10 vertically along the other pair of rods 100, 101 is substantially identical to the mechanism shown in FIG. 13, a detailed description thereof is omitted for the sake of brevity.

The rods 100 and 101 have longitudinal passageways 102 and 105 extending therethrough. The supply chuck 3 has a slide member 3' defining two longitudinal passageways 112 and 113 and bypaths 104 and 109 therein. Pistons 107 and 108 are fixed to the rods 100 and 101 and divide the pass 112 and 113 into upper and lower sections. On the other hand, plugs 116, 117 fixed to slide member 3' close off the upper sections of the passageways 112, 113 while plugs 118, 119 close off the lower sections of the passageways 112, 113. An opening 103 between the passageways 102 and 112 is located above the piston 107 while an opening 106 between the passageways 105 and 113 is located below the piston 108. The upper sections of the passageways 112 and 113 above the pistons 107 and 108 are connected together through the upper bypath 104. The lower sections of the passageways 112 and 113 below the pistons 107 and 108 are connected together through the lower bypath 109. When air is supplied from the upper end 102' of the passageway 102 in the direction of arrow (I), the air is supplied into the upper sections of passageways 112, 113 via the upper bypath 104 and opening 103 so as to move the supply chuck 3 upwardly. On the other hand, when air is supplied from the upper end 105' of the passageway 105 in the direction of arrow (II), the air is supplied into the lower sections of the passageways 112, 113 via opening 106 and the lower bypath 109 so as to move the supply chuck 3 downwardly.

Figure 2:
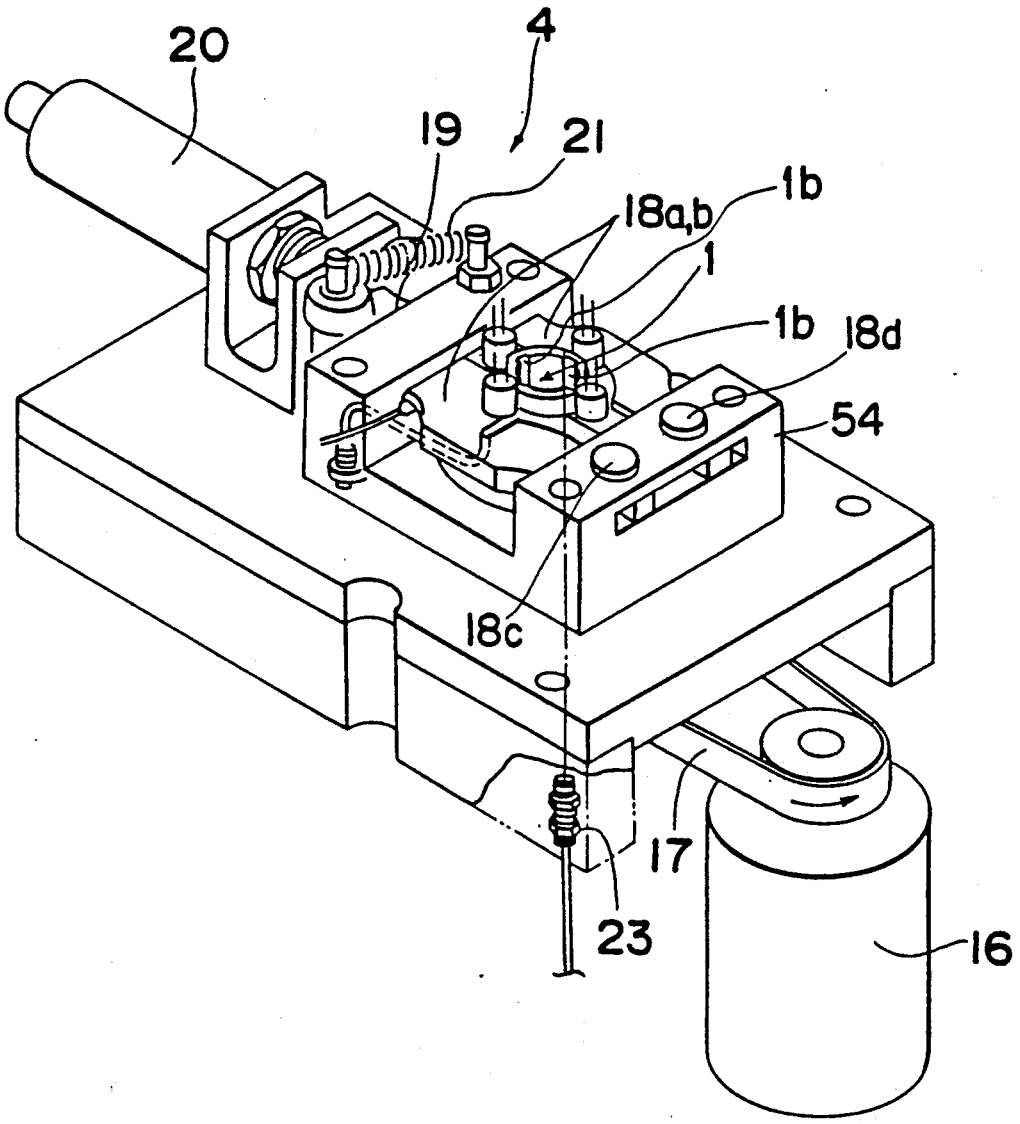
FIG. 2 is a perspective view of the positioning section of the apparatus.
Figure 3A:
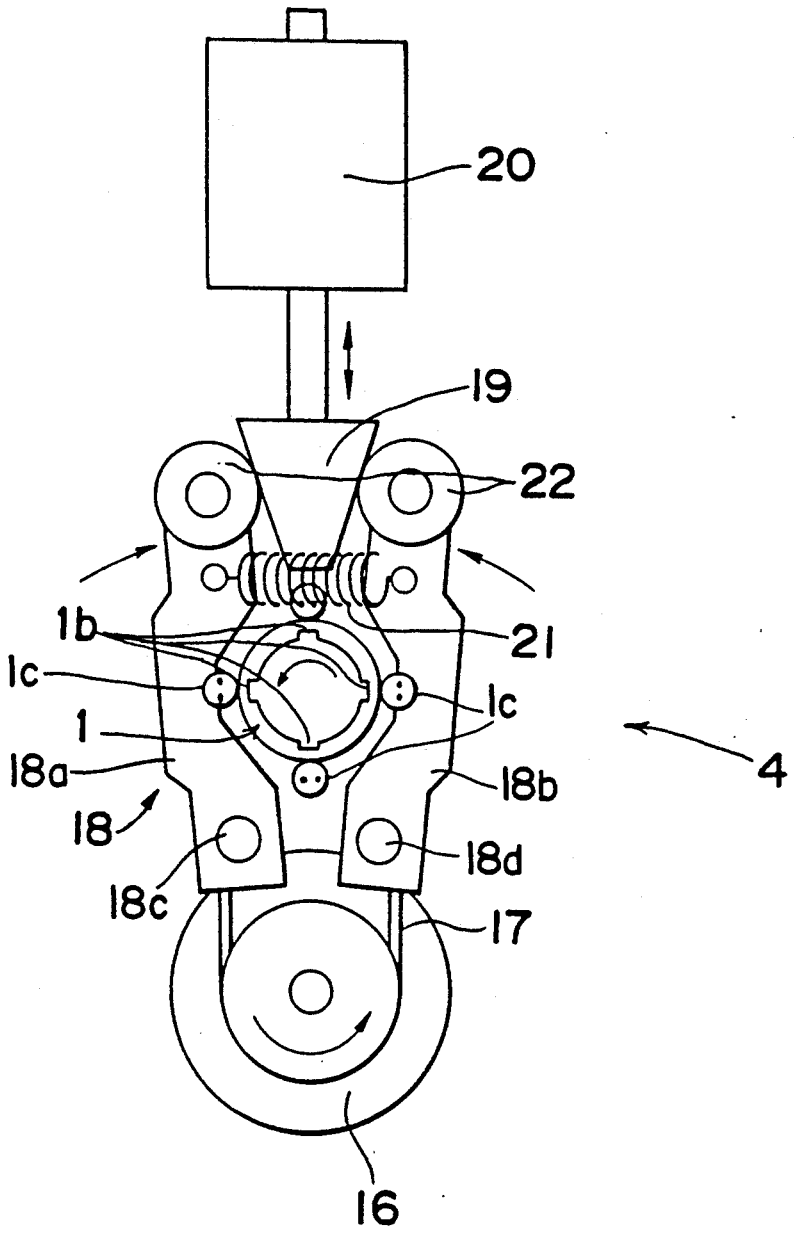
FIG. 3A is a plan view of an essential part of the positioning section of FIG. 2 showing the core chuck in an open position.
Figure 3B:
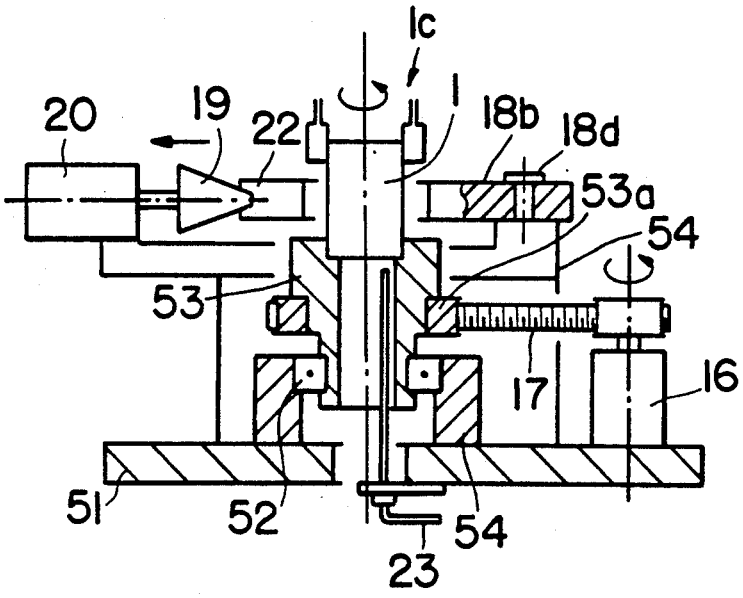
FIG. 3B is a sectional view of the essential part of the positioning section shown in FIG. 3A.

The structure and the operation of the positioning section 4 will now be described referring to FIGS. 2, 3A and 3B. The positioning section 4 rotates the core 1 around its axis with a drive motor 16 through a timing belt 17. Once the core 1 is rotated to a predetermined relative rotary position, the core 1 is clamped with a core chuck 18 having arms 18*a*, 18*b* which are opened and closed by a tapered member 19. Reference numeral 20 designates a solenoid for moving the tapered member 19. Reference numeral 21 designates a spring for urging the arms 18*a*, 18*b* of the core chuck 18 toward a closed position. Reference numeral 22 designates rollers rotatably supported by the core chuck 18 so as to engage the tapered member 19.

Figure 3C:
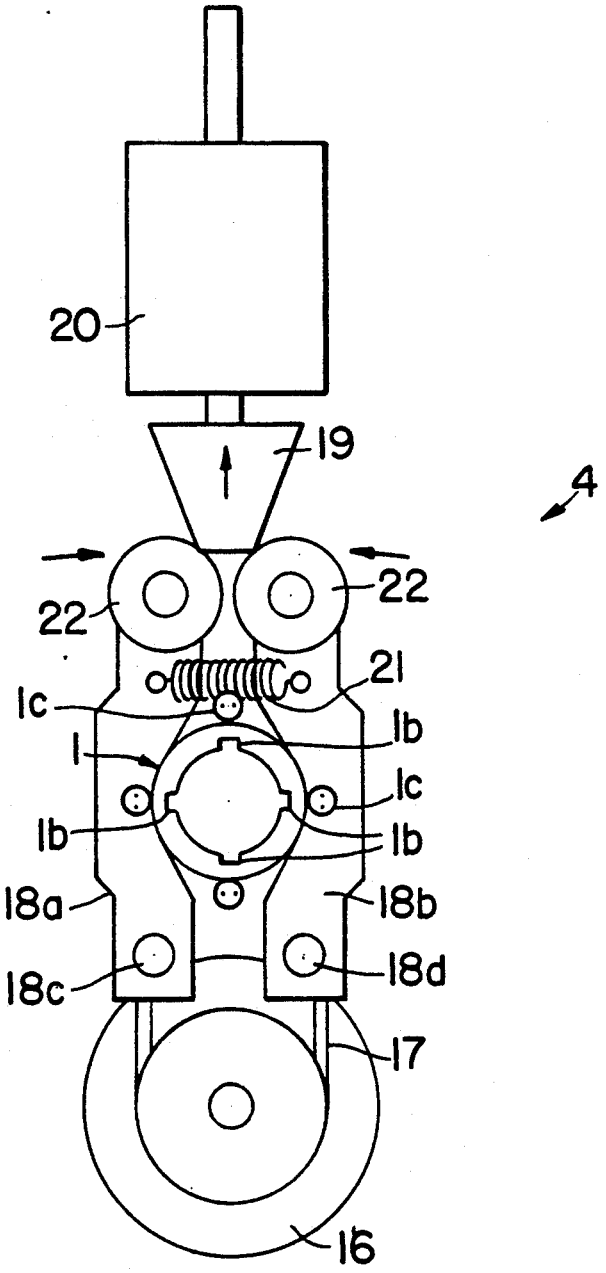
FIG. 3C is a plan view of the essential part of the positioning section of FIG. 2 showing the core chuck in a closed position.

More specifically, the drive motor 16 is fixed on a base plate 51. A rotary table 53 is rotatably supported by a bearing 52. The bearing 52 is supported by a bracket 54 fixed on the base plate 51. A pulley 53*a* integral with rotary table 53 is operatively connected to the motor 16 via the timing belt 17 so that the rotary table 53 will rotate when the timing belt 17 is driven by motor 16. The rollers 22 are rotatably supported by respective ends of the arms 18*a*, 18*b* of the core chuck 18. The other end of each of the arms 18*a*, 18*b* of the core chuck 18 is pivotably supported on a support block 54 by pins 18*c*, 18*d*, respectively. FIG. 3A shows an open position of the core chuck 18 and FIG. 3C shows a closed position thereof.

A non-contact detector 23, such as a reflection-type optical sensor, is supported in the apparatus below the location where the core 1 is seated in the positioning section. The detector 23 is for detecting axial grooves lb formed on the internal surface of the core 1.

That is, the core 1 is seated on the rotary table 53 while the core chuck 18 is in the open position in which the chuck arms 18*a*, 18*b* are spread apart by tapered member 19. Then, the motor 16 operated to rotate the rotary table 53 until the core 1 rotates to a predetermined relative rotary position at which the non-contact detector 23 detects one of the axial grooves 1*b* of the core 1. When the axial groove 1*b* is detected by non-contact detector 23, the motor 16 is immediately stopped, the solenoid 20 is actuated to move the tapered member 19 away from the rollers 22, and the spring 21 urges the arms 18*a*, 18*b* of the core chuck 18 to pivot toward each other about pins 18*c*, 18*d*, thereby clamping the core 1. Thus, the core 1 is held at the predetermined relative rotary position by the arms 18*a*, 18*b* of the core chuck 18 as shown in FIG. 3C so that the core 1 will not move when it is seized by the supply chuck 3. As the core 1 is taken out from between the arms 18*a*, 18*b* of the core chuck 18 by the supply chuck 3, the tapered member 19 is moved between the rollers 22 as engaged therewith to move the arms 18*a*, 18*b* away from each other. Thus, the arms 18*a*, 18*b* of the core chuck 18 pivot about pins 18*c*, 18*d* against the urging force of the spring 21 so that the core 1 is released from between the arms 18*a*, 18*b* of the core chuck 18. Thereafter, the supply chuck 3 is moved upwardly while holding the core 1.

Figure 11:
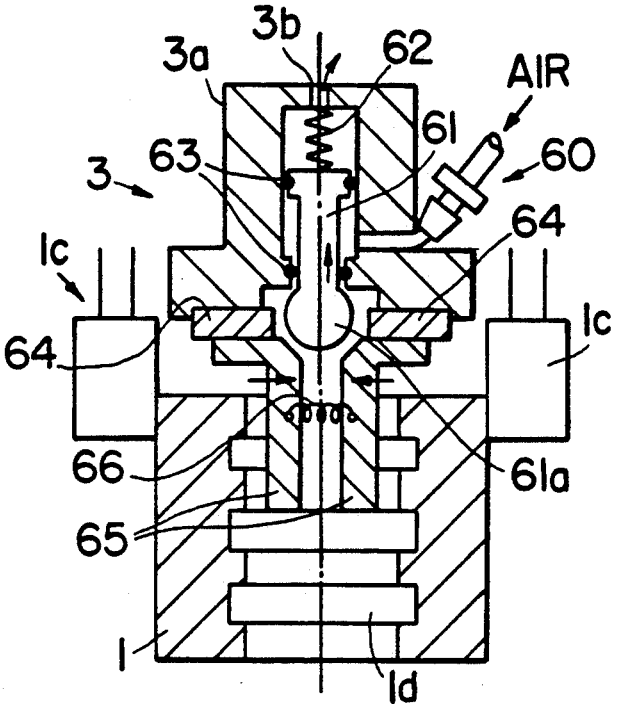
FIG. 11 is a sectional view of a supply chuck and a core in a state in which the core is released.
Figure 12:
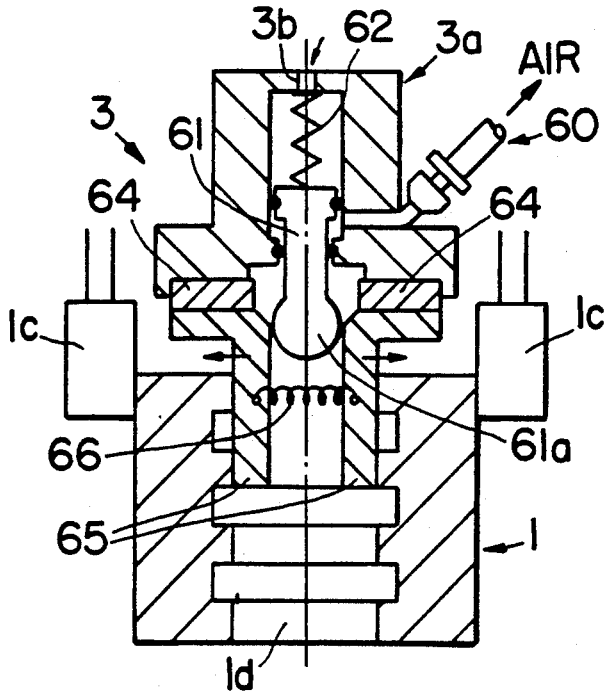
FIG. 12 is a view similar to FIG. 11 but showing the core held by the supply chuck.

Next, the structure of the supply chuck 3 and the manner in which it holds the core 1 will be described with respect to FIGS. 11 and 12. Each chuck 3 has a chuck body 3*a*, slide guide members 64 fixed to the bottom of the body 3*a*, and L-shaped chuck claws 65 mounted to and slidable along the guide members 64. A spring 66 urges the chuck claws 65 toward each other. Reference numeral 3*b* denotes a hole in the top of the chuck body 3*a*. Packings 63 create a seal between a piston rod 61 and the body 3*a*. Air flows in and out of a space defined between the rod 61 and the inner surface of the body 3*a* via an inlet 60. The rod 61 is normally urged downwardly by a spring 62. The rod 61 has a spherical portion 61*a* at its lower end. When air is supplied into the body 3*a* of the chuck 3 via inlet 60, the rod 61 moves upwardly against the urging force of the spring 62. Accordingly, the claws 65 are slid inwardly toward one another along the guide members 64 by the force exerted by the spring 66. The claws 65 can then be inserted into the bore 1*d* of the core 1. In this condition, air is allowed to flow out of the space defined between the rod 61 and the chuck body 3*a* so that the rod 61 will be forced downwardly by the force exerted thereon by the spring 62. The claws 65 are thus moved outwardly in the radial direction of the bore 1*d* of the core 1 by the spherical portion 61*a* of the rod 61 against the force exerted by the spring 66 and while being guided by the guide members 64. Finally, the claws 65 contact the inner surface of the bore 1*d* of the core 1 under pressure and thus the core 1 is held by the claws 65 as shown in FIG. 12. The discharge chuck 10 has the same structure as the supply chuck 3.

Figure 4:
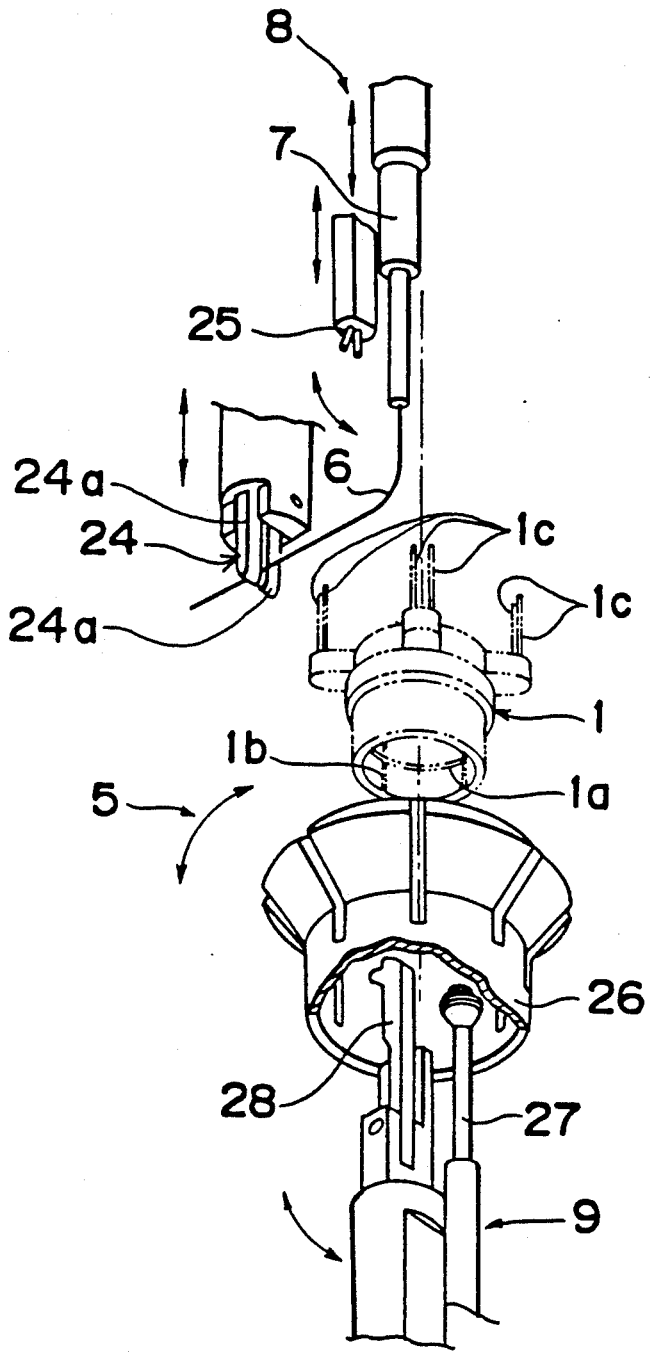
FIG. 4 is a perspective view of the major components of the winding section of the apparatus.
Figure 5:
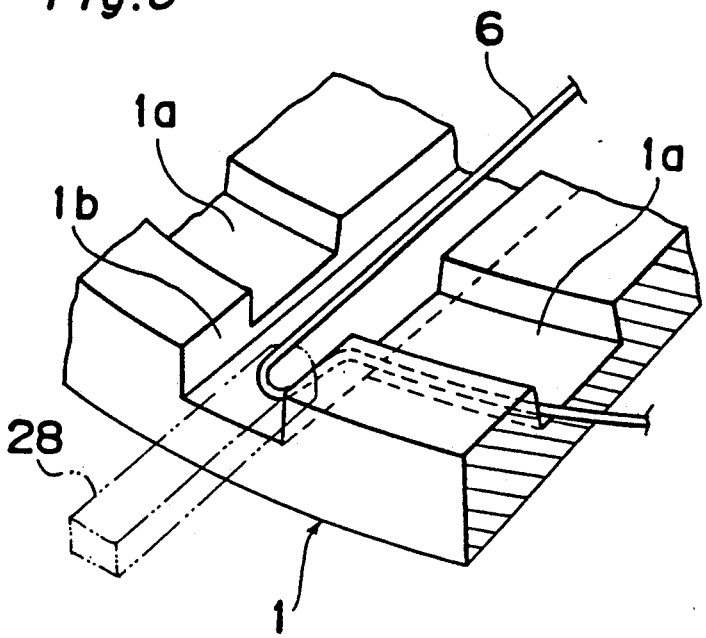
FIGS. 5 and 6 are diagrams each illustrating an essential step in the winding process carried out in the winding section of the apparatus of FIG. 1.
Figure 6:
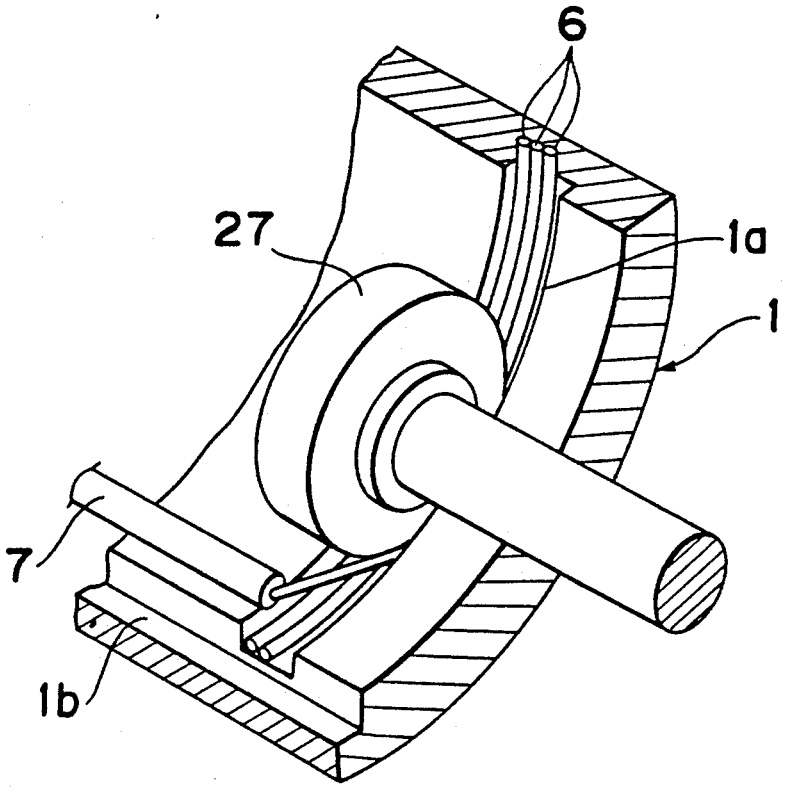

Next, referring to FIGS. 4 to 6, the operative relation between the winding head 8 and the roller member 9 in the winding section 5 will be described. In addition to the supply nozzle 7, the winding head 8 is provided with a holding fitting 24 which includes chuck arms 24*a* for holding the end portion of the wire 6 and with a cutter 25 for cutting the wire 6. A chuck 26 for holding the core 1, the roller member 9 having a press-contact roller 27 for pressing the wire 6 onto the surface of the core 1 defining the bottom of the annular groove 1*a*, and a hooking pin 28 for hooking the portion of the wire 6 extending in the axial groove 1*b* of the core 1, are provided on the base of the winding section 5.

The winding operation is conducted as follows. After the tip end portion of the wire 6 is held with the chuck arms 24*a* of the holding fitting 24, the wire 6 is lapped around an associated pair of the connection pins 1*c* of the core 1 by revolving the supply nozzle 7 around the connection pins. Then the supply nozzle 7 is inserted into the core 1 along an axial groove 1*b* to a position beyond the intersection of the axial groove 1*b* with the annular groove 1*a* and is stopped. As shown in FIG. 5, the wire 6 is hooked to the hooking pin 28 by a tip end portion of the supply nozzle 7 and then, after the supply nozzle 7 is retracted to a position at which the end portion of the supply nozzle 7 confronts the annular groove la, the supply nozzle 7 is moved along the annular groove 1*a*. As shown in FIG. 6, the wire 6 pulled out from the tip end of the supply nozzle 7 is pressed by roller 27 into contact with the surface of the core 1 defining the bottom of the annular groove 1*a*. Thus, a coil of a predetermined number of turns is formed in the annular groove 1*a*. Thereafter, the supply nozzle 7 is pulled out of the core 1 along the axial groove 1*b*, and subsequently the wire 6 is lapped against another pair of associated connection pins 1*c*. After the wire 6 is held by the holding fitting 24, excess wire 6 extending from the connection pins 1*c* is cut off with the cutter 25 to thus complete the winding operation. The intricate movement of the winding head 8 is carried out by the XYZ table 13 on which the head 8 is supported.

Figure 7:
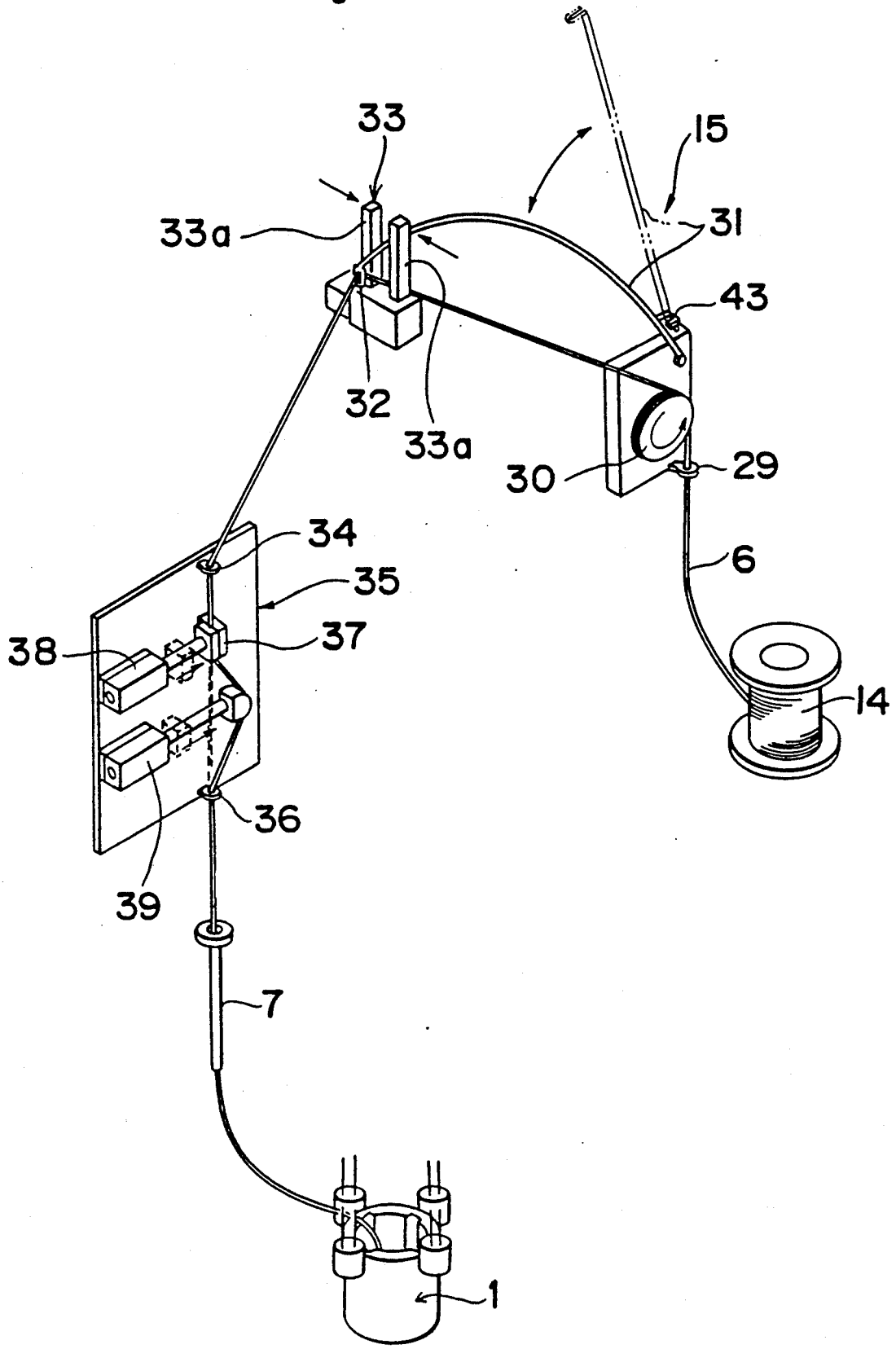
FIG. 7 is a perspective view of the tension device of the apparatus of FIG. 1.

Next, the structure and operation of the tension device 15 for providing the wire 6 with a predetermined amount of tension during the above-described end portion processing and winding process will be described below with reference to FIG. 7. The wire 6 pulled out from the bobbin 14 is wound, through a wire guide 29, around a tension roller 30. Resistance to the rotation of the tension roller 30 is offered by a suitable mechanism or device such as a magnet. Thus, the drawing out of the wire 6 from the tension roller is resisted thereby imparting tension to the wire. Thereafter, the wire 6 is introduced into a first wire guide 32 provided on the tip end of a resilient rod 31 which applies tension to the wire 6 by being bent to the position shown by full lines in FIG. 7. Furthermore, a holding device 33 clamps the end portion of the rod 31 with clamp elements 33*a* to thus fix the rod 31 in the full-line position. The holding device 33 suspends the tension provided by the rod 31 during a certain period of the operation as described below. The wire 6 is supplied to the supply nozzle 7 from the wire guide 32 through a second wire guide 34, a back tension device 35, and a third wire guide 36. The back tension device 35 comprises a press-holding device constituted by a stopper cylinder 38 and a fixing cylinder member 37 against which the wire 6 is held under pressure by the piston of the stopper cylinder 38, and an urging device in the form of a tension cylinder 39 arranged to apply back tension to the wire 6 by moving the wire 6 from a state indicated by the dotted line to a state indicated by the full line in FIG. 7 while the wire is fixed by the stopper cylinder 38 against the fixing cylinder member 37.

The tension device 15 having the above-described structure is used as follows. During the end portion processing wherein the wire 6 is lapped against the associated pair of connection pins 1*c* and when the wire 6 is inserted into the core 1 along its axial groove 1*b*, the clamp elements 33*a* of the holding device 33 are open and the wire is tensioned by rod 31 and tension roller 30 so that large fluctuations in the speed at which the wire is supplied is compensated for. That is, any slackening of the wire 6 during the end portion processing and insertion of the wire along groove la is taken up by the elastic deformation of the rod 31 and by the tension roller 30. Thus, an approximately constant tension of the wire 6 can be maintained.

Next, when the supply nozzle 7 is stopped at the position beyond the annular groove la and the coil wire 6 is hooked by the hooking pin 28 (FIG. 5), the wire 6 is fixed in position by forcing the wire 6 against the fixing cylinder member 37 with the piston of the stopper cylinder 38, and the tension cylinder 39 is actuated to impart a large back tension to the wire 6. In this state, the supply nozzle 7 is retracted to be located at the annular groove 1*a*. The wire 6 remains hooked near the boundary between the axial groove 1*b* and the annular groove 1*a* while slackness or looseness of the wire 6 is prevented by tension cylinder 39 so that the wire 6 will not fall out of the annular groove 1*a* as it is begun to be wound into a coil in the annular groove 1*a*. The tension at this time may be set to an appropriate value by adjusting the stroke and pressure of the tension cylinder 39.

Finally, as the wire 6 is wound into a coil in the annular groove 1*a*, the operation of the back tension device 35 is stopped, i.e. the cylinders 38 and 39 are retracted, and the tip end of the rod 31 is clamped by the clamp elements 33*a* of the clamping device 33 so that the rod 31 cannot flex and cause tension fluctuations to occur. Thus, while the wire 6 is wound into a coil it is under a constant state of tension provided by the mechanism of the tension roller 30.

Figure 8:
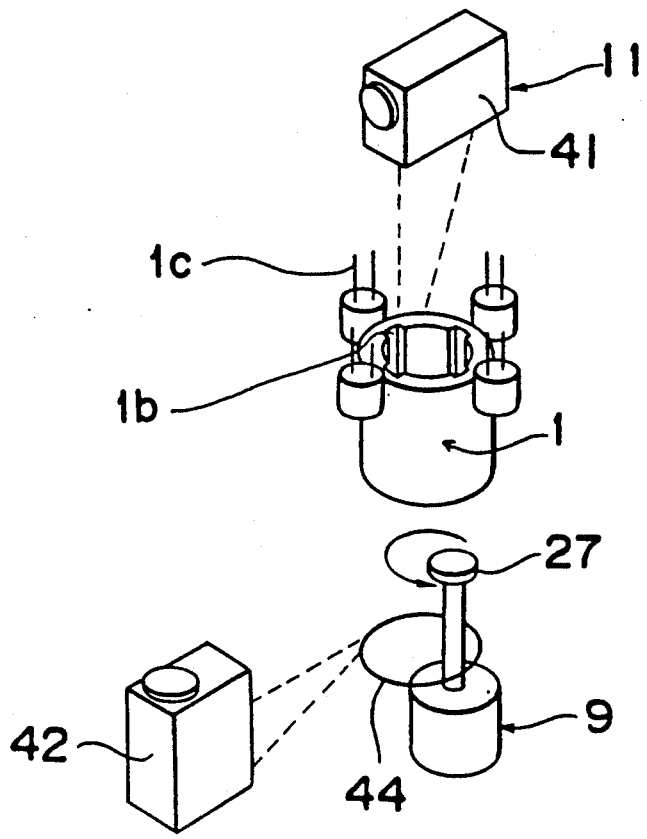
FIG. 8 is a perspective view of the inspection section of the apparatus of FIG. 1.
Figure 9:
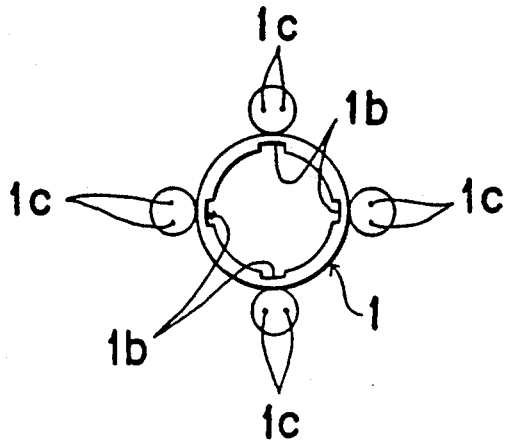
FIG. 9 is a plan view of an acceptable product.
Figure 10:
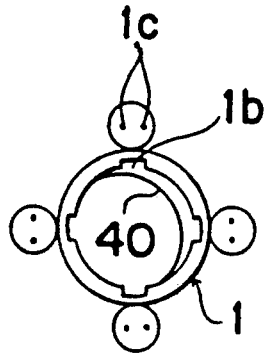
FIG. 10 is a plan view of an unacceptable product.

Next, the structure and operation of the inspection section 11 will be described with reference to FIGS. 8 to 10. When the winding of the wire 6 into a coil is completed, the discharge chuck 10 seizes the core 1 at the winding section 5 and is moved toward the core 1 at the winding section 5. The inspection section 11 includes a non-contact detector 41, such as a reflection-type optical sensor, disposed on the discharge chuck 10. The detector 41 is thus positioned above the core 1 to detect whether the coil and the core 1 constitute an acceptable product. In an acceptable product, the coil does not project inwardly of the inner periphery of the core 1, as shown in FIG. 9. In an unacceptable product, a coil 40 projects inwardly of the inner periphery of the core 1, as shown in FIG. 10, in which case the coil 40 can be detected by the non-contact detector 41. It is to be noted that during the inspection, the core 1 is rotated around its axis by a suitable rotary drive mechanism coupled to the chuck 26 of the winding section 5.

Furthermore, when the coil falls from the annular groove 1*a* due to such a defect as being broken during the winding process, the coil (44 in FIG. 8) will be retained by the press-contact roller 27 of the roller member 9, where it can be detected with a non-contact detector 42. Furthermore, if the coil breaks during the winding process, the rod 31 will return to its natural state of the dotted line position shown in FIG. 7. Accordingly, this condition may be detected by a detector 43 such as a microswitch.

A more detailed description of the sequence of operations of the robot 12 and mechanisms for moving the supply and discharge chucks 3, 10 to the various positions outlined above will now be made with reference to FIGS. 14A–14P.

Figure 14A:
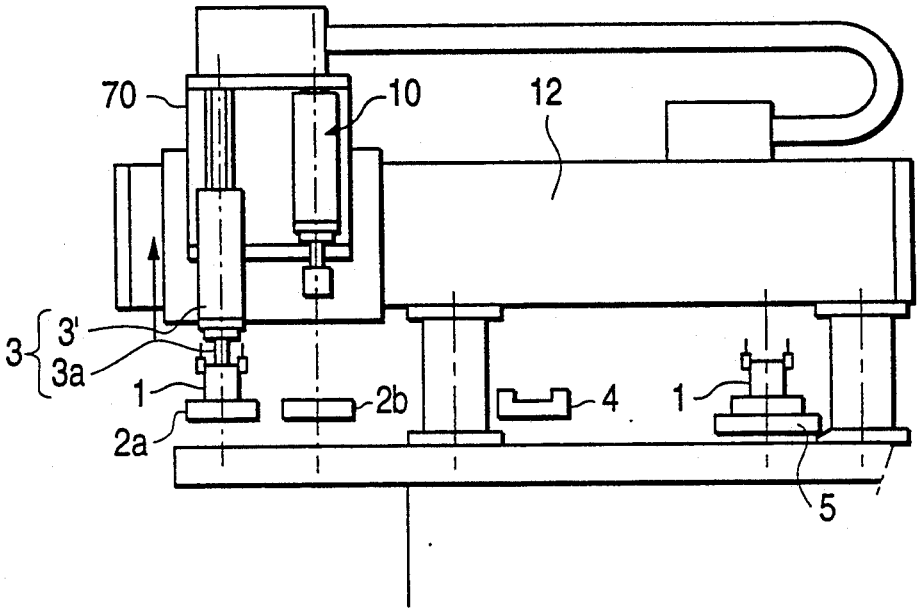
FIGS. 14A–14P are schematic diagrams illustrating a sequence of operations executed by the robot and supply and discharge chucks of the apparatus.
Figure 14B:
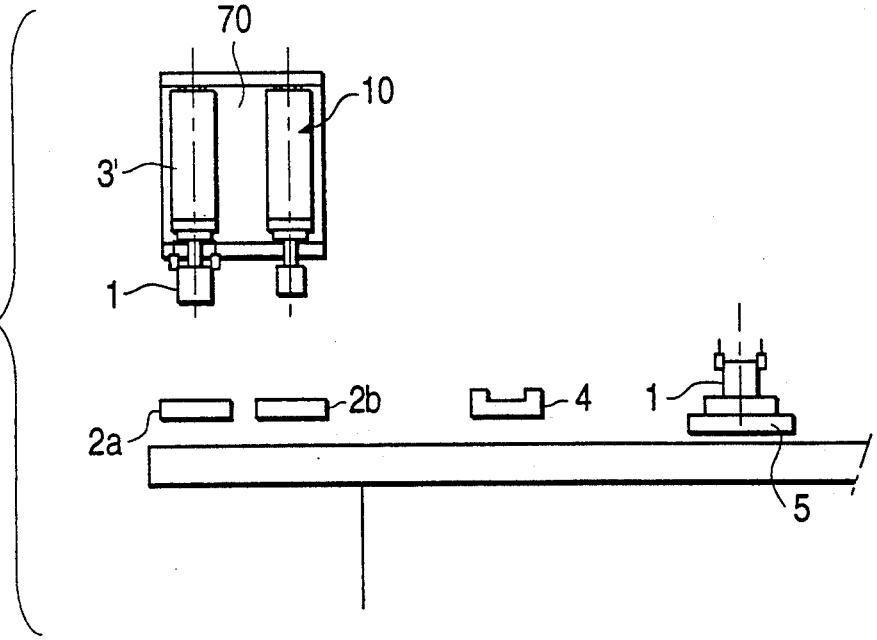

In FIG. 14A, the support plate 70 is located at a supply and discharge position where the supply chuck 3 is located above the carry-in conveyer 2*a* and the discharge chuck 10 is located above the carry-out conveyer 2*b*. From this position, after the supply chuck 3 has been moved downwardly and has seized a core 1 transferred by the carry-in conveyer 2*a*, the supply chuck 3 is moved upwardly while holding core 1 with its claws 65 (FIG. 14B). The discharge chuck 10 does not move during this sequence. The discharge chuck 10 remains at its vertical position during the sequence from FIG. 14A to FIG. 14G.

Figure 14C:
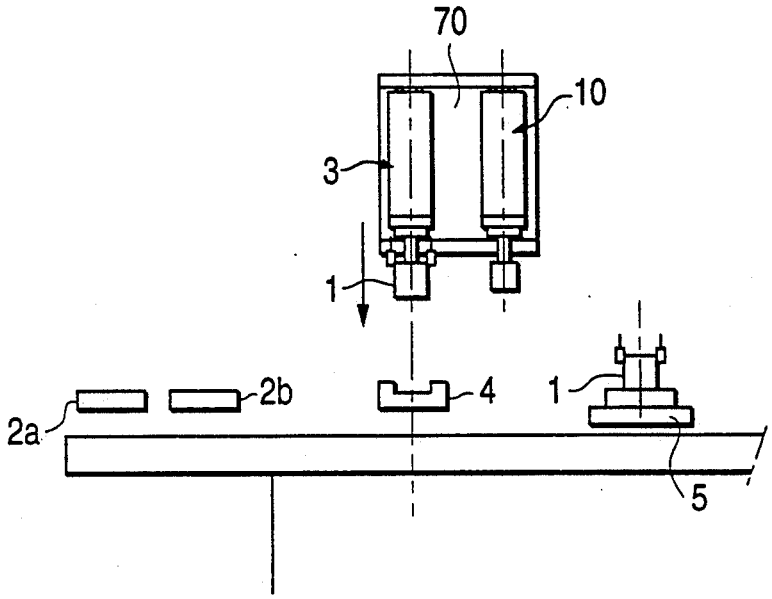

After the supply chuck 3 reaches its uppermost limit position, the robot 12 moves the plate 70 (to the right in the figure) to a position at which the core 1 held by the supply chuck 3 confronts the positioning section 4 (FIG. 14C).

Figure 14D:
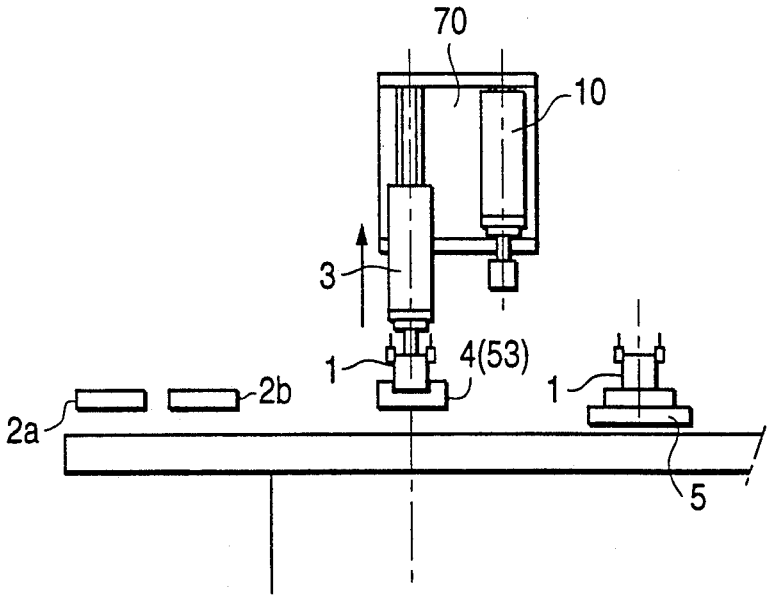

After the support plate 70 stops at the position shown in FIG. 14C, the supply chuck 3 is moved downwardly to place the core 1 on the rotary table 53 (FIG. 14D).

Figure 14E:
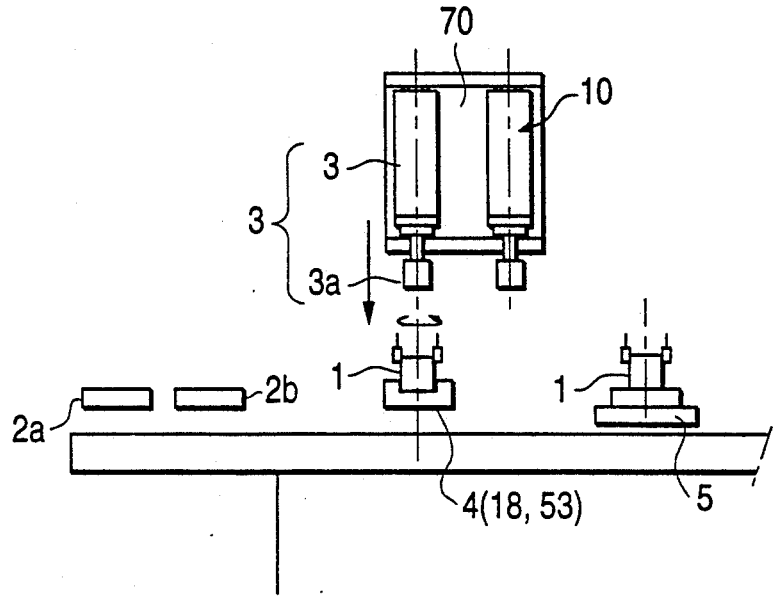

After the core 1 has been placed on the rotary table 53, the supply chuck 3 is moved upwardly having released the core 1. The core 1 is rotated to the predetermined relative rotary position by the rotary table 53 and is then clamped by the core chuck 18 (FIG. 14E).

Figure 14F:
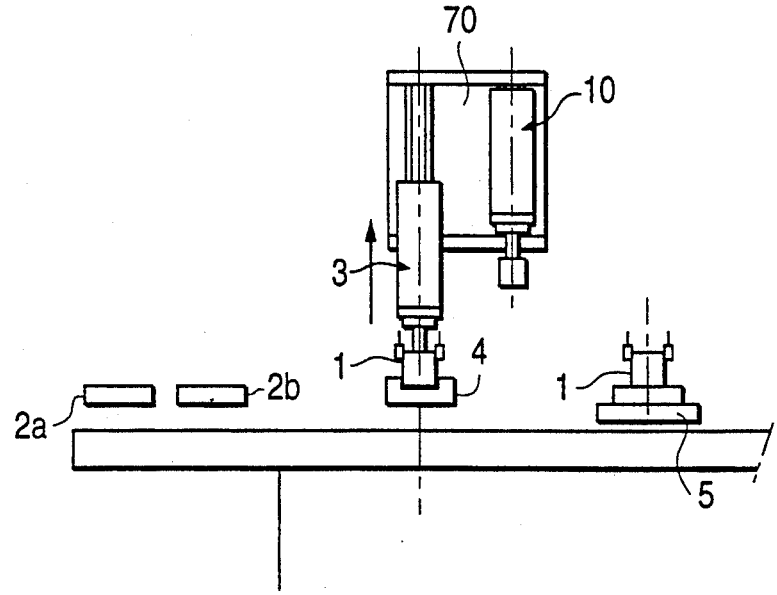

Next, the supply chuck 3 is moved downwardly and seizes the core 1 with the claws 65 while the core is clamped in position by core chuck 18. Then the core chuck 18 releases the core 1 (FIG. 14F).

Figure 14G:
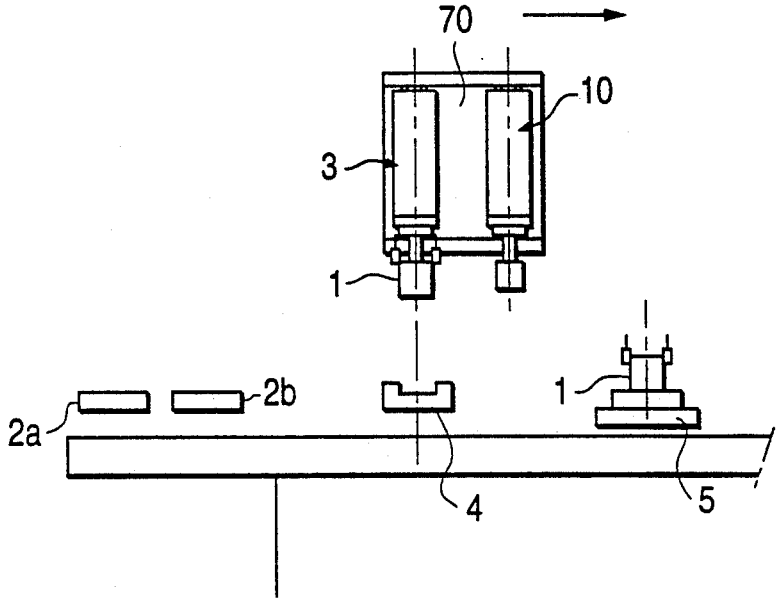
Figure 14H:
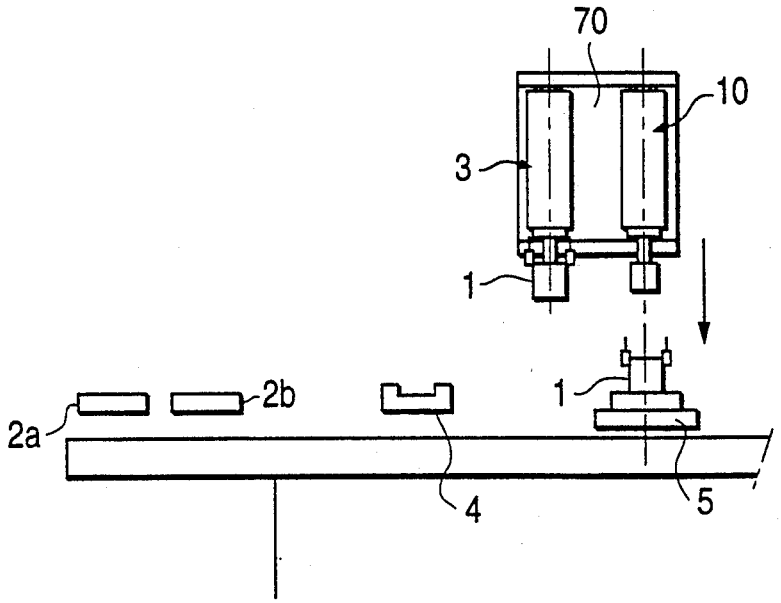

Thereafter, the supply chuck 3 is moved upwardly while holding the core 1 which is positioned at the predetermined relative rotary position (FIG. 14G).

After the supply chuck 3 reaches its uppermost limit position, the support plate 70 is moved to the right from FIG. 14G. The supply chuck 3 remains at its uppermost vertical position during the sequence from FIG. 14G to FIG. 14J.

Figure 14I:
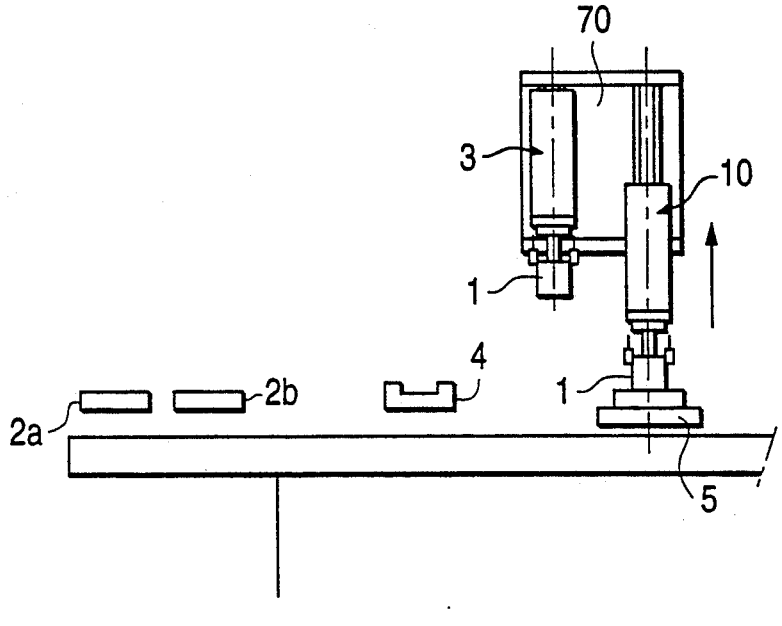

After the plate 70 reaches a position where the discharge chuck 10 is located above the winding section 5 (FIG. 14H), the discharge chuck 10 is moved downwardly and seizes a core 1 which has had a coil formed therein at the winding section 5 (FIG. 14I). The winding process is executed during the sequence from FIG. 14M, i.e. after a core has been supplied to the winding section 5, to FIG. 14G.

Figure 14J:
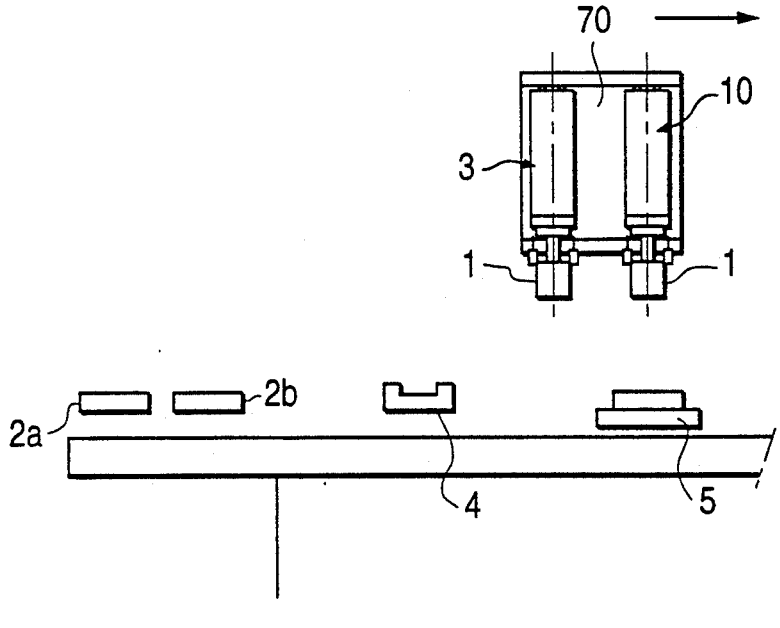

Next, the discharge chuck 10 is moved upwardly to its uppermost limit position while holding the core 1 (FIG. 14J).

Figure 14K:
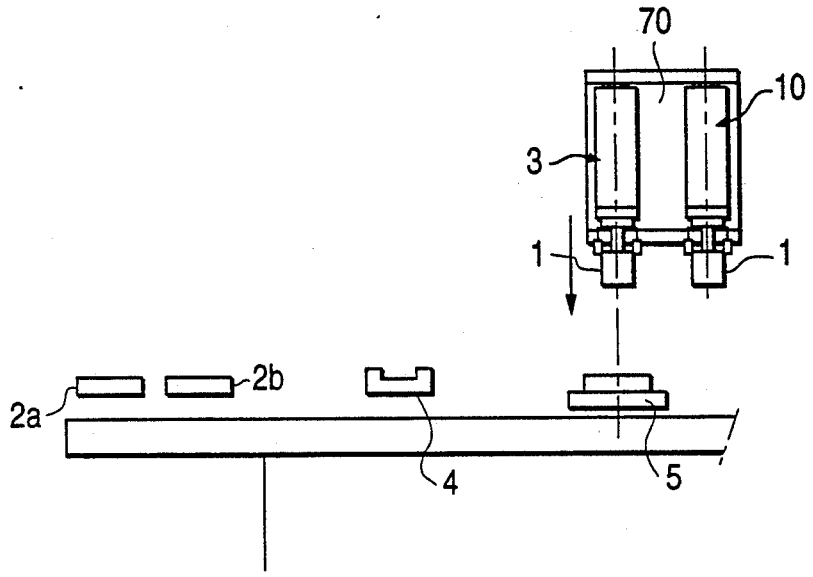

The support plate 70 is moved until the supply chuck 3 is located above the winding section 5, while the cores 1 are held by the supply chuck 3 and the discharge chuck 10 (FIG. 14K). The discharge chuck 10 remains in its uppermost vertical position during the sequence from FIG. 14J to FIG. 14M.

Figure 14L:
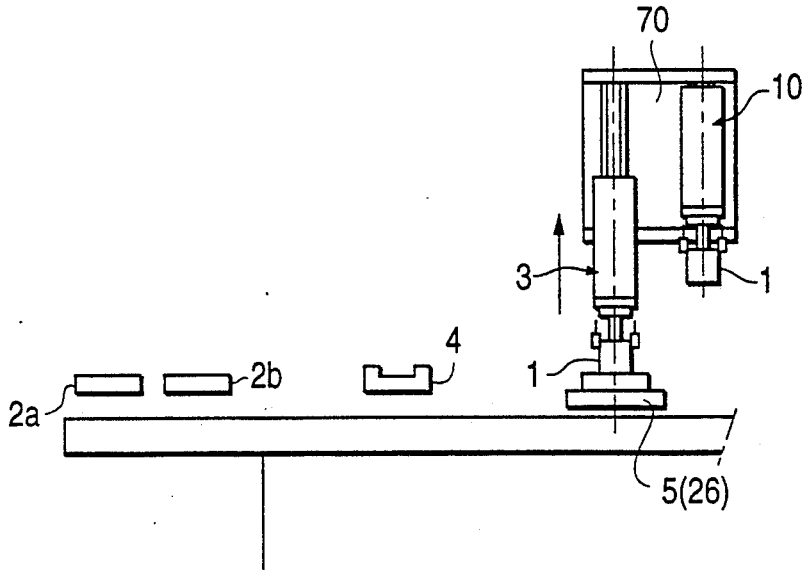

After the supply chuck 3 reaches the winding section 5, the supply chuck 3 is moved downwardly to place the core 1 into the chuck 26 of the winding section 5 (FIG. 14L).

Figure 14M:
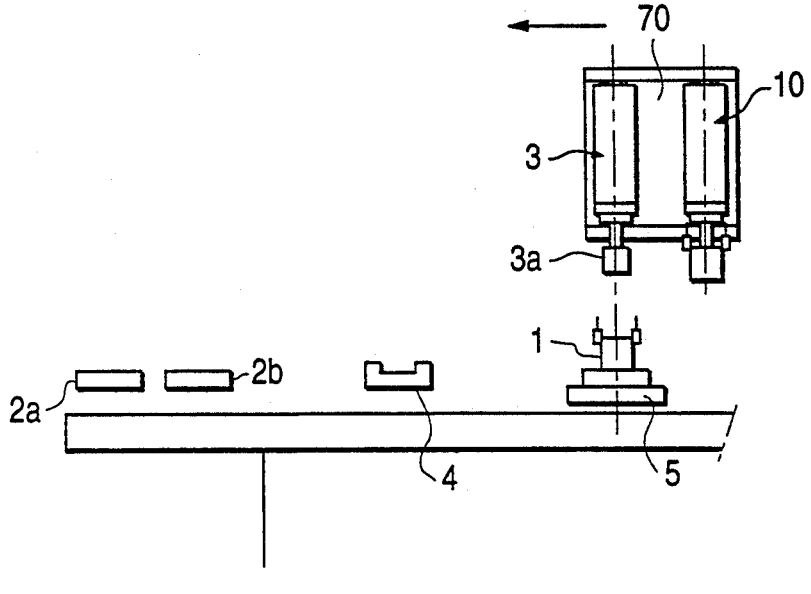

After the core 1 which has been held by the supply chuck 3 is chucked at the winding section 5, the supply chuck 3 is moved upwardly to its uppermost limit position (FIG. 14M).

Figure 14N:
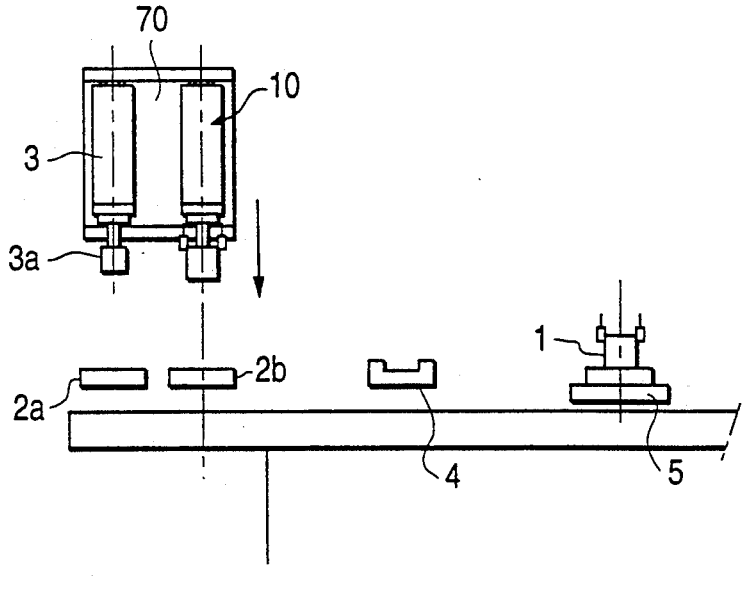
Figure 14O:
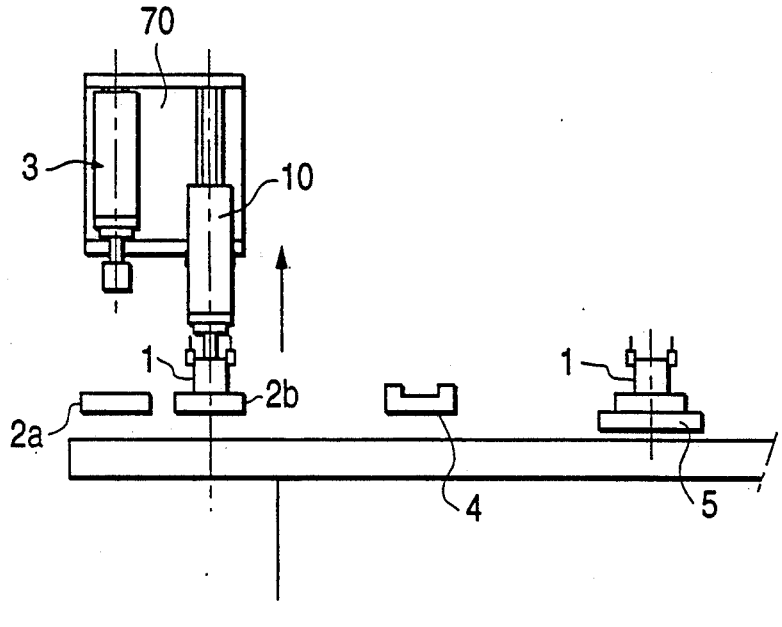

The plate 70 is moved to the supply and discharge position (to the left in FIG. 14M) where the supply chuck 3 is located above the carry-in conveyer **2*a* and the discharge chuck 10 is located above the carry-out conveyer 2*b* (FIG. 14N**).

At the supply and discharge position, the discharge chuck 10 is moved downwardly to place the core 1 on the carry-out conveyer **2*b* (FIG. 140**).

After the discharge chuck 10 places the core 1 on the carryout conveyer **2*b*, the discharge chuck 10 is moved to its uppermost limit position (FIG. 140). The core 1 placed on the carry-out conveyer 2*b*** is transferred out of the apparatus.

Figure 14P:
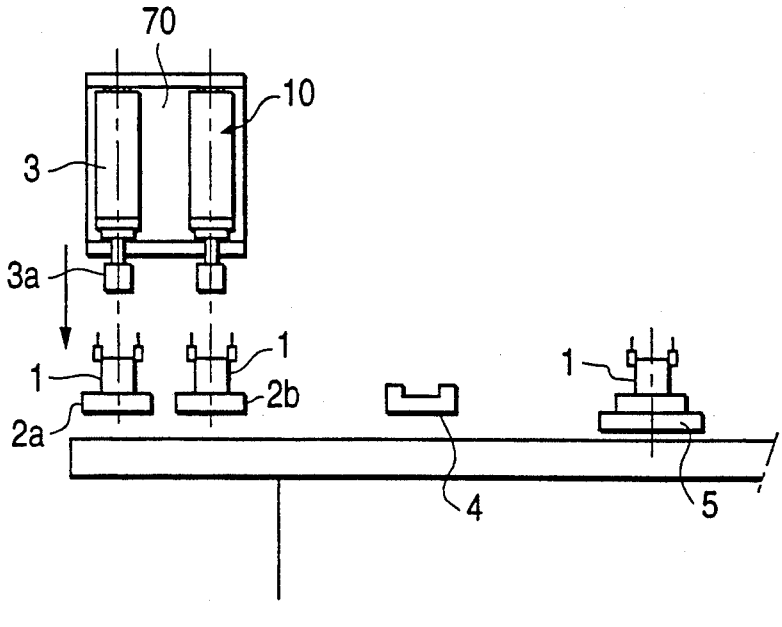

Finally, the supply chuck 3 is moved downwardly to seize a core 1 on the carry-in conveyer **2*a* (FIG. 14P). The sequence is then repeated beginning at FIG. 14A**.

As is clear from the foregoing description, in the winding apparatus according to the present invention, the positioning of the cylindrical body, such as a rotor core 1, the winding process, and an inspection step are carried out automatically and sequentially. Appropriate tensions are applied to the wire 6 during the winding process and the end portion processing of the wire 6, respectively. Therefore, there is no slack in the wire 6 when the end portion processing and the winding process are performed sequentially.

Furthermore, by using a non-contact device, i.e. detector 23, for detecting the axial groove lb of the core 1, the core 1 can be positioned reliably without being damaged or chipped.

Furthermore, by appropriately employing the wire holding device 38, 37 and the urging device 39 in conjunction with the resistance offered by the mechanism of the pull-out resistance providing device 30, slackness in the wire can be ensuredly prevented during the transition from the end portion processing to the winding process. Further, by using the rod 31 capable of absorbing large fluctuations in the coil wire supply, and by selectively actuating the holding device 33 which can suspend the effect produced by the rod 31, large fluctuations in the supply of the wire during end portion processing can be absorbed and subsequently a stable tension can be imparted to the wire during the winding process. Thus, the coil formed in the core 1 will be in a properly wound state.

Furthermore, an inspection means inspects the wound state of the coil without contacting the core or coil. Thus, inspections can be carried out efficiently.

Although the present invention has been fully described in connection with a preferred embodiment thereof, it is to be noted that various changes and modifications will become apparent to those skilled in the art. Such changes and modifications are to be understood as included within the scope of the present invention as defined by the appended claims unless they otherwise depart therefrom.

What is claimed is:

1. Apparatus for winding wire into a coil in an annular groove defined at the inner surface of a cylindrical body which also has an axially extending groove intersecting the annular groove, said apparatus comprising:

a positioning section including positioning means for positioning a cylindrical body at a predetermined relative rotary position;

a winding section including a wire supply nozzle through which wire is supplied, a roller, and XYZ table means for moving said wire supply nozzle and said roller in three dimensions relative to a cylindrical body set at the winding section, whereby wire can be supplied along the annular groove of a cylindrical body set at the winding section by moving the supply nozzle along the annular groove and whereby the wire can be pressed by said roller against a surface of the cylindrical body defining the bottom of said annular groove as it is being wound into a coil;

a robot operative to move a cylindrical body at least from said positioning section to said winding section, whereby a cylindrical body positioned at said positioning section can be moved to and set at said winding section by said robot;

a tensioning device associated with said supply nozzle so as to apply tension to the wire being supplied by said supply nozzle, said tensioning device being operative to selectively adjust the tension applied to the wire while the coil is being formed; and inspection means for determining whether a coil wound in the cylindrical body is in an acceptable state.

2. Apparatus for winding wire into a coil as claimed in claim 1, wherein said positioning means includes a rotary mechanism which rotates a cylindrical body set thereon, and a non-contact detector which detects an axial groove of the cylindrical body without contacting the cylindrical body.

3. Apparatus for winding wire into a coil as claimed in claim 1, wherein the tensioning device includes a mechanism offering resistance against the wire being drawn out and supplied to the supply nozzle, a press-holding device operatively interposed between said mechanism and the supply nozzle with respect to a path along which the wire is guided to the supply nozzle, said press-holding device being capable of holding the wire under pressure, and an urging device interposed between said press-holding device and said supply nozzle with respect to said path, said urging device being movable into engagement with the wire while the wire is held by the press-holding device to thereby back-tension the wire.

4. Apparatus for winding wire into a coil as claimed in claim 1, wherein the tensioning device includes a mechanism offering resistance against the wire being drawn out and supplied to the supply nozzle, a rod having a guide portion at one end thereof, the rod being biased from its free state so as to apply tension to wire received in the guide portion thereof, and a holding device capable of selectively holding the rod at a location which prevents the rod from applying tension to wire received in said guide portion.

5. Apparatus for winding wire into a coil as claimed in claim 1, wherein said inspection means is a non-contact detector which detects whether the coil produced projects from the annular groove of the cylindrical body without contacting the cylindrical body.

* * * * *